US008366288B1

(12) United States Patent
Lin

(10) Patent No.: US 8,366,288 B1
(45) Date of Patent: Feb. 5, 2013

(54) LIGHTING EYELASH CURLER

(76) Inventor: Hsiao-Yun Lin, Changhua (TW)

( * ) Notice: Subject to any disclaimer, the term of this patent is extended or adjusted under 35 U.S.C. 154(b) by 0 days.

(21) Appl. No.: 13/238,174

(22) Filed: Sep. 21, 2011

(51) Int. Cl.
*A45D 2/48* (2006.01)

(52) U.S. Cl. ..... 362/115; 362/109; 362/119

(58) Field of Classification Search ..... 362/109, 362/115, 119, 200, 249.02
See application file for complete search history.

(56) References Cited

U.S. PATENT DOCUMENTS

| | | | | |
|---|---|---|---|---|
| 5,944,028 | A * | 8/1999 | Gebhard | 132/216 |
| 6,009,884 | A * | 1/2000 | Suh | 132/217 |
| 2002/0129829 | A1 * | 9/2002 | Yamaguchi et al. | 132/217 |
| 2006/0005851 | A1 * | 1/2006 | Cho | 132/217 |
| 2012/0228281 | A1 * | 9/2012 | Haan | 219/222 |

* cited by examiner

*Primary Examiner* — David V Bruce
(74) *Attorney, Agent, or Firm* — Alan Kamrath; Kamrath IP Lawfirm, P.A.

(57) ABSTRACT

A lighting eyelash curler includes a main board having a space securely receiving a circuit board. A fence is provided on a front end of the main board. Compartments are defined between sidewalls of the fence and sidewalls of the main board. Light-emitting diodes are mounted in at least one of the compartments and electrically connected to the circuit board. A movable clamp, a fixed clamp, and a turnover plate are mounted to the front end of the main board. The turnover plate includes a rotating plate, a catch, and a rotating shaft between the rotating plate and the rotating shaft. A catch hole is defined in a rear end of the movable clamp and receives the catch. Through provision of the light-emitting diodes, the lighting eyelash curler can be used in an environment having a dim light and has simple structure while allowing easy operation.

9 Claims, 7 Drawing Sheets

LIGHTING EYELASH CURLER

BACKGROUND OF THE INVENTION

The present invention relates to a beauty tool and, more particularly, to a lighting eyelash curler.

There are more and more activities pursuant to the development of societies. Beauty tools, such as eyelash curlers, are carried by people while going out. However, facial treatment is not easy in some places having a dim light at night. As an example, poor trimming of the eyelashes may occur in some places having poor illumination at night, such as on a Taxi or at the stairs or passageways, so that the eye portions of the user are not bright and colorful enough, adversely affecting the beauty effect.

BRIEF SUMMARY OF THE INVENTION

An objective of the present invention is to provide a lighting eyelash curler providing illumination to fix the problems in current eyelash curlers.

The present invention fulfills the above objective by providing a lighting eyelash curler including a main board having left and right sidewalls. A space is defined in a rear end of the main board. A circuit board is fixed in the space. Two power contacts are provided on a top face of a rear end of the circuit board and respectively connected to positive and negative poles of a power source. Two power output contacts are provided on a front end of the circuit board. A U-shaped fence is provided on a front end of the main board. A first compartment is defined between a left sidewall of the fence and the left sidewall of the main board. A second compartment is defined between a right sidewall of the fence and the right sidewall of the main board. A plurality of light-emitting diodes is mounted in at least one of the first and second compartments and has two power contacts electrically connected to the two power output contacts of the circuit board. A movable clamp is mounted to the front end of the main board. The front end of the main board includes a movement hole slideably receiving the movable clamp. The movable clamp has a rear end received in the U-shaped fence. Each of the left and right sidewalls of the fence has a support seat. A turnover plate is mounted to the support seats and includes a rotating plate at a front, a catch at a rear, and a rotating shaft between the rotating plate and the catch. Through-holes are defined in a rear end of the rotating plate and in a front end of the catch. An intermediate portion of the rotating shaft is received in the through-holes of the rotating plate and the catch. Two ends of the rotating shaft abut with the support seats. A catch hole is defined in the rear end of the movable clamp and receives the catch. A fixed clamp is mounted to the front end of the main board and includes a fixing board at a rear, a pressing board at a front, and two links between the fixing board and the pressing board. The fixing board of the fixed clamp is fixed to an intermediate portion of an upper face of the main board. The links are spaced from each other and each has two ends respectively connected to the fixing board and the pressing board. A space is defined by the fixing board, the two links, and the pressing board and matches with the front end of the turnover plate. An intermediate portion of a lower face of each of the two links includes a first recess and a second recess for matching with the support seats and the plurality of light-emitting diodes. The intermediate portions of the links cover the first and second compartments formed by the left and right sidewalls of the main board and the U-shaped fence. A lid and a power source lid are mounted to the upper face of the main board. The lid is located in an intermediate portion of the upper face of the main board and engaged with the main board. The power source lid is located in a rear end of the upper face of the main board and engaged with the lid.

Preferably, the movable clamp includes a movement groove in an intermediate portion thereof. A guard is formed on an intermediate portion of the movement hole. The guard matches with the movement groove and is located in the movement hole.

Preferably, the elastic element is a spring. A positioning peg is provided on the rear end of the movement groove. The guard includes left and right sidewalls extending therefrom. The front end of the spring fixed in a compartment defined between the guard and the left and right sidewalls of the guard. The rear end of the spring mounted around the positioning peg.

Preferably, a groove is defined in the front end of the movable clamp, and a rubber pad is received in the groove.

Preferably, the circuit board includes a switch contact. A mounting hole is defined in the main board or the lid. The mounting hole receives a button aligned with the switch contact on the circuit board.

Preferably, the circuit board further includes an IC chip for controlling the lighting patterns of the plurality of light-emitting diodes.

Preferably, the rear end of the main board includes a mounting hole, and another rubber pad is received in the mounting hole.

Preferably, two engagement blocks are provided in the space and fixed to left and right sidewalls of the main board. Each engagement block includes an engagement notch engaged with the circuit board. Thus, the circuit board is engaged with the engagement blocks.

Preferably, a connecting board is connected between the links and includes an intermediate portion fixed to the front end of the main board.

The present invention will become clearer in light of the following detailed description of illustrative embodiments of this invention described in connection with the drawings.

DETAILED DESCRIPTION OF THE INVENTION

Figure 1:
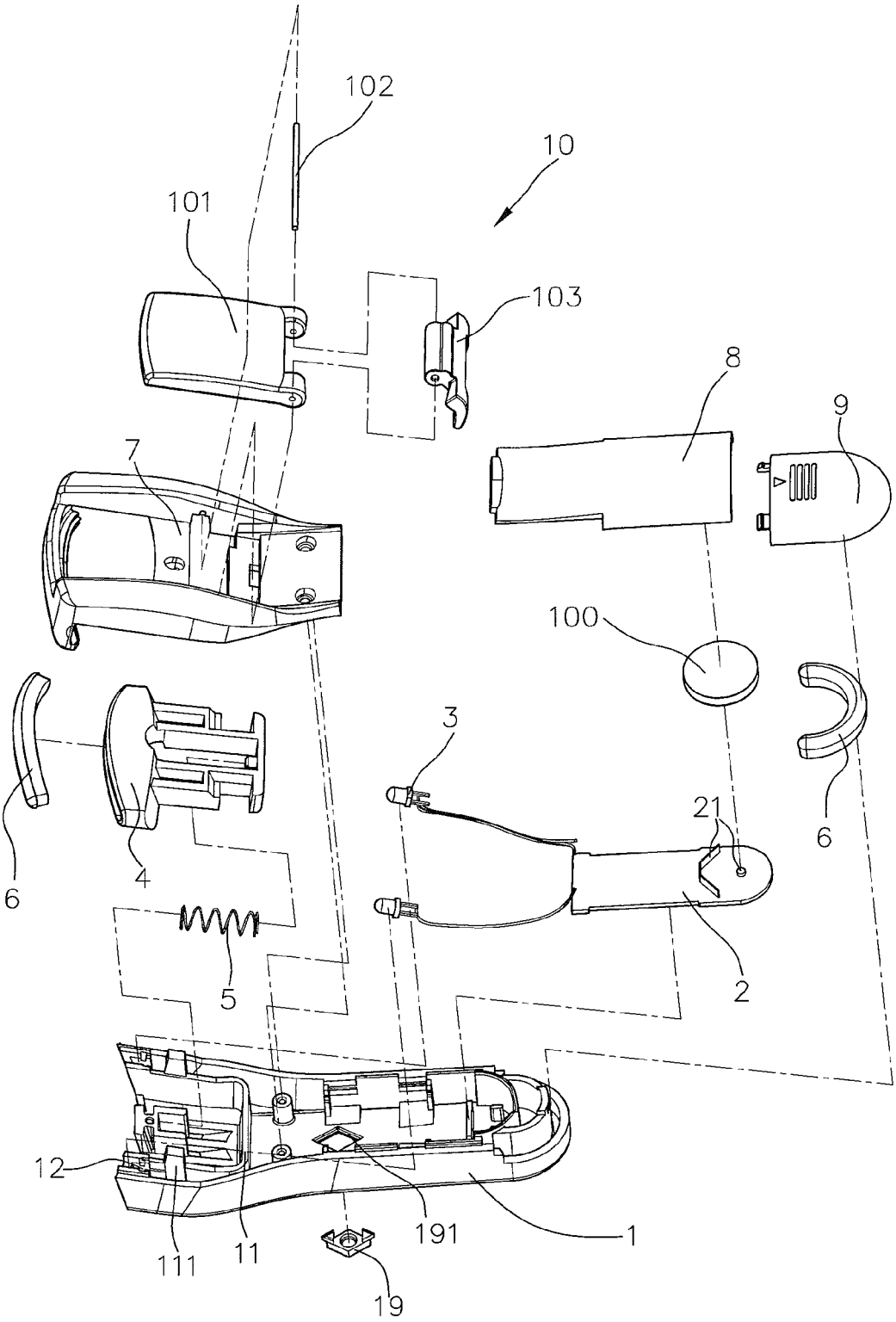
FIG. 1 shows an exploded, perspective view of a lighting eyelash curler according to the present invention.
Figure 2:
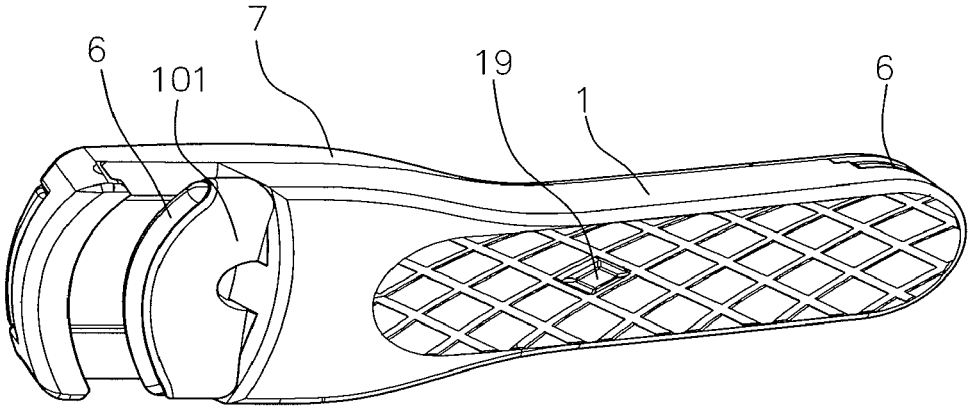
FIG. 2 shows a perspective view of the lighting eyelash curler according to the present invention.
Figure 3:
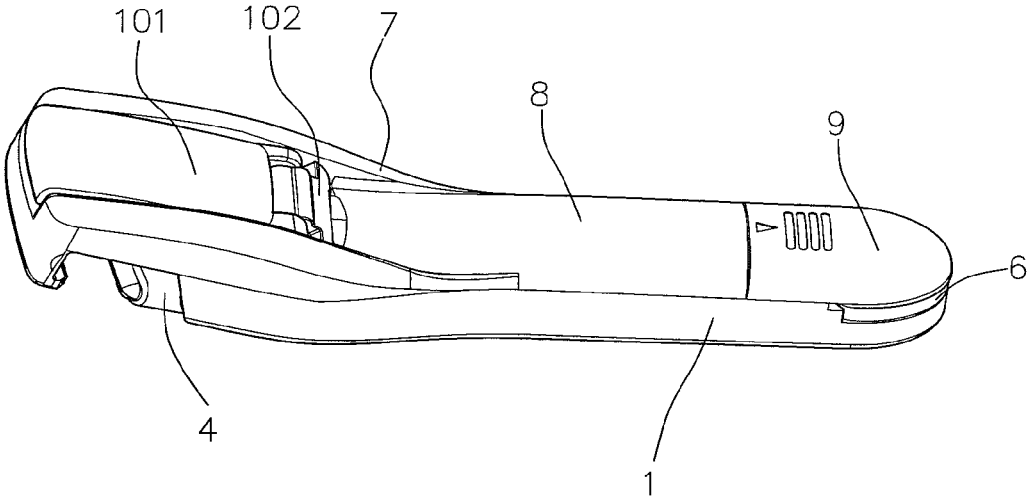
FIG. 3 shows another perspective view of the lighting eyelash curler according to the present invention.
Figure 4:
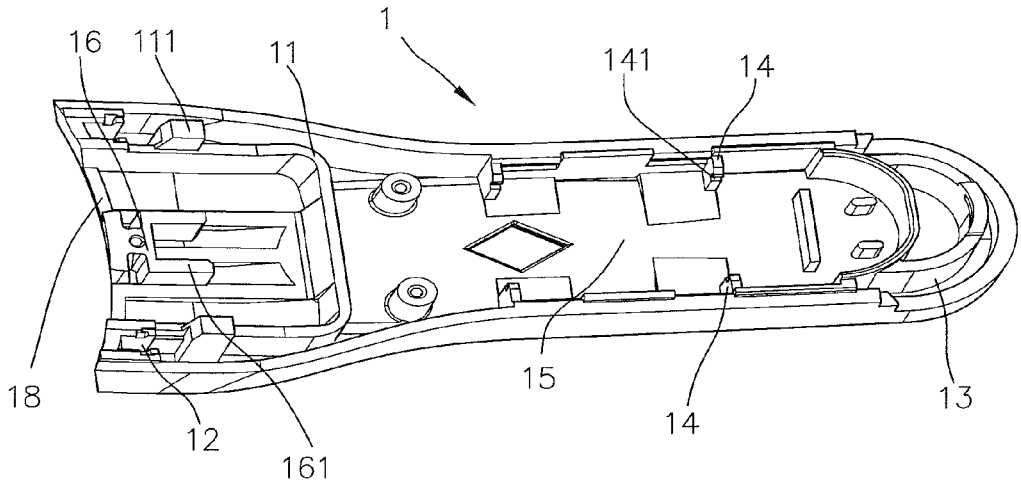
FIG. 4 shows a perspective view of a main board of the lighting eyelash curler according to the present invention.
Figure 5:
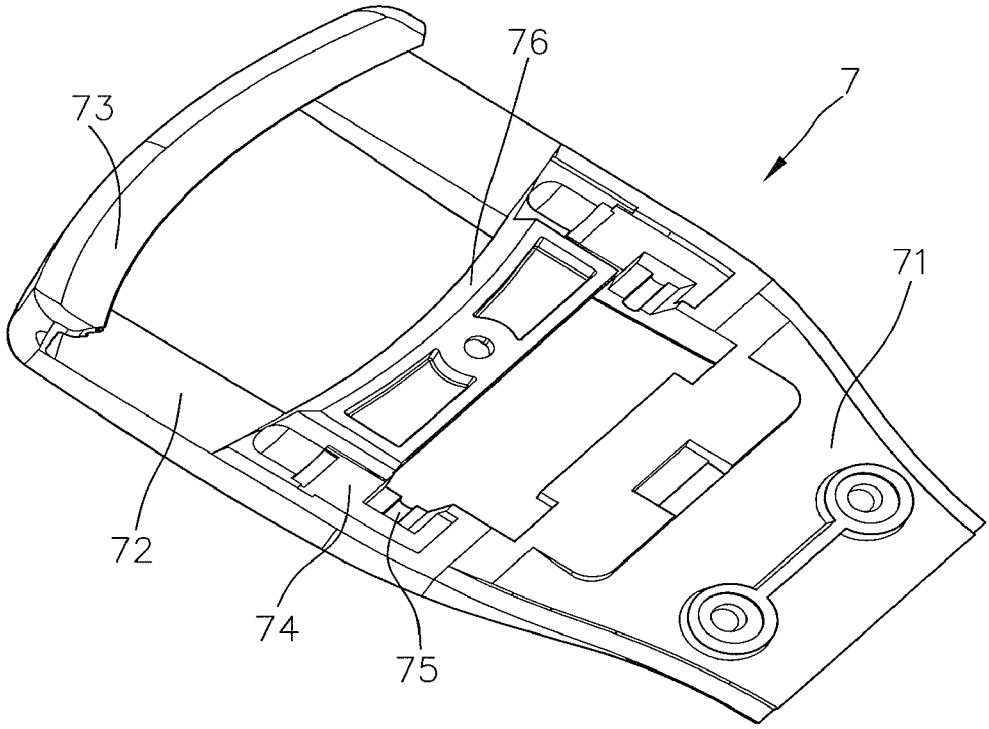
FIG. 5 shows a perspective view of a fixed clamp of the lighting eyelash curler according to the present invention.

With reference to FIGS. 1-7, a lighting eyelash curler according to the present invention includes a main board 1 with left and right sidewalls. A space 15 is defined in a rear end of the main board 1. A circuit board 2 is fixed in the space 15. Two power contacts 21 are provided on a top face of a rear end of the circuit board 2 and respectively connected to the positive and negative poles of a power source 100. Two power output contacts are provided on a front end of the circuit board 2. A U-shaped fence 11 is provided on a front end of the main board 1. A compartment 12 is defined between a left sidewall of the fence 11 and the left sidewall of the main board 1. Another compartment 12 is defined between a right sidewall of the fence 11 and the right sidewall of the main board 1. Light-emitting diodes (LED) 3 are mounted in at least one of the compartments 12 and have two power contacts electrically connected to the power output contacts of the circuit board 2.

A movable clamp 4 is mounted to the front end of the main board 1. The front end of the main board 1 includes a movement hole 18 slideably receiving the movable clamp 4. A rear end of the movable clamp 4 is received in the U-shaped fence 11. Each of the left and right sidewalls of the fence 11 has a support seat 111. A turnover plate 10 is mounted to the support seats 111 and includes a rotating plate 101 at the front, a catch 103 at the rear, and a rotating shaft 102 between the rotating plate 101 and the catch 103. Through-holes are defined in a rear end of the rotating plate 101 and in a front end of the catch 103. An intermediate portion of the rotating shaft 102 is received in the through-holes of the rotating plate 101 and the catch 103. Two ends of the rotating shaft 102 abut with the support seats 111. A catch hole 42 is defined in the rear end of the movable clamp 4 and receives the catch 103.

A fixed clamp 7 is mounted to the front end of the main board 1 and includes a fixing board 71 at the rear, a pressing board 73 at the front, and two links 72 between the fixing board 71 and the pressing board 73. The fixing board 71 of the fixed clamp 7 is fixed to an intermediate portion of an upper face of the main board 1. The links 72 are spaced from each other and each have two ends respectively connected to the fixing board 71 and the pressing board 73. A receiving space defined by the fixing board 71, the links 72, and the pressing board 73 and matches with the front end of the turnover plate 10. An intermediate portion of a lower face of each link 72 includes a first recess 75 and a second recess 74 for matching with the support seats 111 and the light-emitting diodes E. The intermediate portions of the link 72 cover the compartments 12 formed by the left and right sidewalls of the main board 1 and the U-shaped fence 11. A lid 8 and a power source lid 9 are mounted to the upper face of the main board 1. The lid 8 is located in an intermediate portion of the upper face of the main board 1 and engages with the main board 1. The power source lid 9 is located in a rear end of the upper face of the main board 1 and engages with the lid 8.

In use, the power source lid 9 is removed from the rear end of the upper face of the main board 1, and the power source 100 is mounted to the circuit board 2. Thus, the circuit board 2 can control lighting of the light-emitting diodes E on the front end of the lighting eyelash curler. The turnover plate 10 is turned by its front end, pivoting the turnover plate 10 about an axis defined by the rotating shaft 102. The catch 103 at the rear end of the turnover plate 10 pushes the movable clamp 4 to move forward/rearward along the left and right sidewalls of the U-shaped fence 11. When the catch 103 pushes the movable clamp 4 forward so that the front end of the movable clamp 4 is adjacent to the fixing board 71 of the fixed clamp 7, trimming of eyelashes can be carried out. By such an arrangement, eyelash trimming can be done with illumination, avoiding poor trimming in a dark area and, hence, avoiding poor image resulting from poor light.

Figure 6:
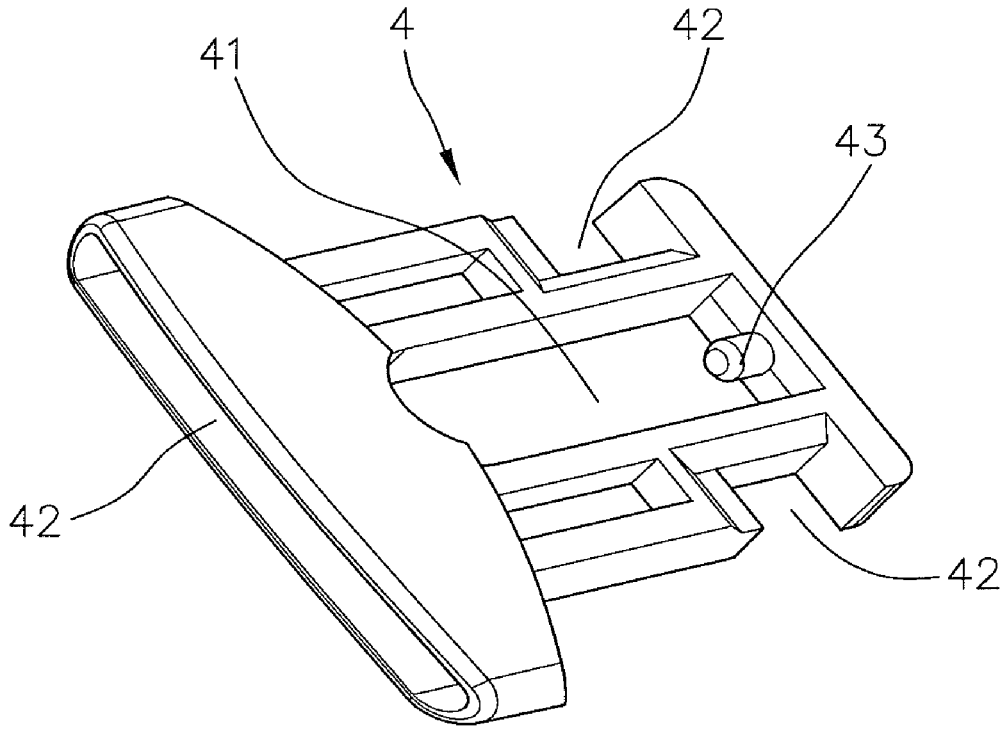
FIG. 6 shows a perspective view of a movable clamp of the lighting eyelash curler according to the present invention.
Figure 7:
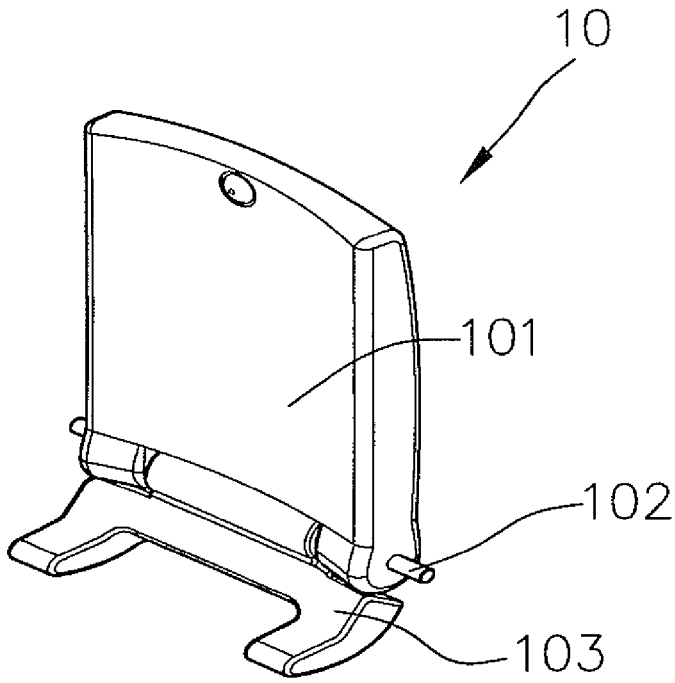
FIG. 7 shows a perspective view of a turnover plate of the lighting eyelash curler according to the present invention.

With reference to FIG. 6, the movable clamp 4 includes a movement groove 41 in an intermediate portion thereof. A guard 16 is formed on an intermediate portion of the movement hole 18. The guard 16 matches with the movement groove 41 and located in the movement hole 41. An elastic element is received in the movement groove 41 and includes a front end abutting against the fence 16 and a rear end abutting against a rear end of the movement groove 41. Through provision of the movement groove 41 and the elastic element, the movable clamp 4 is biased by the elastic element towards the rear end of the U-shaped fence 11. When the turnover plate 10 of the lighting eyelash curler provides no active force, the movable clamp 4 can be reset under the action of the elastic element to retain the lighting eyelash curler in the open state. When operating the lighting eyelash curler, eyelash trimming can be carried out by simply closing the lighting eyelash curler. The operation is more convenient by resetting the movable clamp 4 under the action of the elastic element.

The elastic element is a spring 5 in the form shown. A positioning peg 43 is provided on the rear end of the movement groove 41. The guard 16 includes left and right sidewalls 161 extending therefrom. The front end of the spring 5 is fixed in a compartment defined between the guard 16 and the left and right sidewalls 161. The rear end of the spring 5 is mounted around the positioning peg 43. Use of the spring 5 is convenient and useful. The spring 5 fixed in the movement groove 41 avoids undesired shifting of the spring 5 due to vibration during use. Thus, the movable clamp 4 can be reliably returned.

A groove 44 is defined in the front end of the movable clamp 4 and receives a rubber pad 6. When using the lighting eyelash curler to trim eyelashes, the eyelashes of the human body are located between the front end of the movable clamp 4 and the pressing board 73 of the fixed clamp 7. By mounting the rubber pad 6 on the front end of the movable clamp 4, soft contact can be provided between the eyelashes and the movable clamp 4 to adjust the clamping force between the movable clamp 4 and the fixed clamp 7.

The circuit board 2 includes a switch contact. A mounting hole 191 is defined in the main board 1 or the lid 8. In the form shown, the mounting hole 191 is defined in the main board 1 and receives a button 19 aligned with the switch contact on the circuit board 2. The lower face of the main board 1 can include a pattern corresponding to a shape of the button 19 to provide easy handling and aesthetically pleasing effect. Opening and closing of the circuit can be controlled through the button 19.

The circuit board 2 further includes an IC chip for controlling the lighting patterns of the light-emitting diodes 3.

The rear end of the main board 1 includes a mounting hole 13 receiving another rubber pad 6. The rubber pad 6 is a spare pad for replacement when the rubber pad 6 at the front end of the movable 4 is worn out, avoiding adversely affect to the makeup.

Two engagement blocks 14 are provided in the space 15 and fixed to left and right sidewalls of the main board 1. Each engagement block 14 includes an engagement notch 141 for engagement with the circuit board 2. The circuit board 2 is engaged with the engagement blocks 14. By securely fixing the circuit board 2 in the space 15 with the engagement blocks 14, impingement and damage to the circuit board 2 during use of the lighting eyelash curler can be avoided.

A connecting board 76 is connected between the links 72 and includes an intermediate portion fixed to the front end of the main board 1. The connecting board 76 reinforces the relative fixed position between the links 72. Furthermore, the connecting board 76 fix the fixed clamp 7 to the main board 1, preventing loosening of the fixed clamp 7.

Although specific embodiments have been illustrated and described, numerous modifications and variations are still possible without departing from the essence of the invention. The scope of the invention is limited by the accompanying claims.

The invention claimed is:

1. A lighting eyelash curler comprising:

a main board including left and right sidewalls, with a space defined in a rear end of the main board, with a circuit board fixed in the space, with two power contacts provided on a top face of a rear end of the circuit board and respectively connected to positive and negative poles of a power source, with two power output contacts provided on a front end of the circuit board, with a U-shaped fence provided on a front end of the main board, with a first compartment defined between a left sidewall of the fence and the left sidewall of the main board, with a second compartment defined between a right sidewall of the fence and the right sidewall of the main board, with a plurality of light-emitting diodes mounted in at least one of the first and second compartments and having two power contacts electrically connected to the two power output contacts of the circuit board;

a movable clamp mounted to the front end of the main board, with the front end of the main board including a movement hole slideably receiving the movable clamp, with the movable clamp having a rear end received in the U-shaped fence, with each of the left and right sidewalls of the fence having a support seat, with a turnover plate mounted to the support seats and including a rotating plate at a front, a catch at a rear, and a rotating shaft between the rotating plate and the catch, with through-holes defined in a rear end of the rotating plate and in a front end of the catch, with an intermediate portion of the rotating shaft received in the through-holes of the rotating plate and the catch, with two ends of the rotating shaft abutting with the support seats, with a catch hole defined in the rear end of the movable clamp and receiving the catch;

a fixed clamp mounted to the front end of the main board and including a fixing board at a rear, a pressing board at a front, and two links between the fixing board and the pressing board, with the fixing board of the fixed clamp fixed to an intermediate portion of an upper face of the main board, with the two links spaced from each other and each having two ends respectively connected to the fixing board and the pressing board, with a receiving space defined by the fixing board, the two links, and the pressing board and matching with the front end of the turnover plate, with an intermediate portion of a lower face of each of the two links including a first recess and a second recess for matching with the support seats and the plurality of light-emitting diodes, with the intermediate portions of the two links covering the first and second compartments formed by the left and right sidewalls of the main board and the U-shaped fence, with a lid and a power source lid being mounted to the upper face of the main board, with the lid located in an intermediate portion of the upper face of the main board and engaged with the main board, with the power source lid located in a rear end of the upper face of the main board and engaged with the lid.

2. The lighting eyelash curler as claimed in claim 1, with the movable clamp including a movement groove in an intermediate portion thereof, with a guard formed on an intermediate portion of the movement hole, with the guard matching with the movement groove and located in the movement hole.

3. The lighting eyelash curler as claimed in claim 2, with the elastic element being a spring, with a positioning peg provided on the rear end of the movement groove, with the guard including left and right sidewalls extending therefrom, with the front end of the spring fixed in a compartment defined between the guard and the left and right sidewalls of the guard, with the rear end of the spring mounted around the positioning peg.

4. The lighting eyelash curler as claimed in claim 1, with a groove defined in the front end of the movable clamp, with a rubber pad received in the groove.

5. The lighting eyelash curler as claimed in claim 1, with the circuit board including a switch contact, with a mounting hole defined in the main board or the lid, with the mounting hole receiving a button, with the button aligned with the switch contact on the circuit board.

6. The lighting eyelash curler as claimed in claim 1, with the circuit board further including an IC chip, with the IC chip controls lighting patterns of the plurality of light-emitting diodes.

7. The lighting eyelash curler as claimed in claim 4, with the rear end of the main board including a mounting hole, with the mounting hole receiving another rubber pad.

8. The lighting eyelash curler as claimed in claim 1, with two engagement blocks provided in the space and fixed to left and right sidewalls of the main board, with each of the engagement blocks including an engagement notch engaged with the circuit board, with the circuit board engaged with the engagement blocks.

9. The lighting eyelash curler as claimed in claim 1, wherein a connecting board is connected between the two links and includes an intermediate portion fixed to the front end of the main board.

* * * * *